US007559433B2

(12) United States Patent
Yang et al.

(10) Patent No.: US 7,559,433 B2
(45) Date of Patent: Jul. 14, 2009

(54) TRASH CAN ASSEMBLY WITH LOCKING LID

(75) Inventors: Frank Yang, Rancho Palos Verdes, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 358 days.

(21) Appl. No.: 11/007,100

(22) Filed: Dec. 7, 2004

(65) Prior Publication Data

US 2005/0230397 A1 Oct. 20, 2005

Related U.S. Application Data

(63) Continuation-in-part of application No. 10/828,067, filed on Apr. 19, 2004, now Pat. No. 7,086,550.

(51) Int. Cl.
*B65D 43/16* (2006.01)

(52) U.S. Cl. ..... 220/832; 220/263; 220/262; 220/908; 220/831; 220/264

(58) Field of Classification Search ..... 220/262, 220/263, 264, 908, 831, 832, 261
See application file for complete search history.

(56) References Cited

U.S. PATENT DOCUMENTS 1,842,603 A * 1/1932 Gray ..... 220/831
1,891,651 A * 12/1932 Padelford et al. ..... 220/263
1,948,413 A * 2/1934 Carola ..... 220/263
2,001,445 A * 5/1935 Abele ..... 220/263
2,563,456 A * 8/1951 Brownell ..... 220/263
2,811,329 A * 10/1957 Press et al. ..... 248/147
4,081,105 A * 3/1978 Dagonnet et al. ..... 220/263
5,011,036 A * 4/1991 Souza et al. ..... 220/263
5,029,347 A * 7/1991 Lin ..... 4/246.2
5,170,904 A * 12/1992 Neuhaus ..... 220/262
5,531,348 A * 7/1996 Baker et al. ..... 220/264
5,639,002 A * 6/1997 Weitbrecht et al. ..... 224/539
6,010,024 A * 1/2000 Wang ..... 220/23.87
6,250,492 B1 * 6/2001 Verbeek ..... 220/495.11
6,332,554 B1 * 12/2001 McCarthy ..... 220/554
6,626,317 B2 * 9/2003 Pfiefer et al. ..... 220/263
6,789,537 B1 * 9/2004 Lutz et al. ..... 126/25 R
7,086,550 B2 * 8/2006 Yang et al. ..... 220/263
2001/0020619 A1 * 9/2001 Pfeifer et al. ..... 220/263

* cited by examiner

*Primary Examiner*—Anthony D Stashick
*Assistant Examiner*—Christopher B McKinley
(74) *Attorney, Agent, or Firm*—Raymond Sun

(57) ABSTRACT

A trash can assembly has a shell, a lid fitted over the top end of the shell, a foot pedal positioned adjacent the bottom end of the shell, a link assembly coupling the foot pedal and the lid, and a locking member associated with the shell. The locking member engages the rod of the link assembly to maintain the lid in an open position without pressing the foot pedal.

13 Claims, 6 Drawing Sheets

48
28
58
X1
44
42
50
60
46
40
52
62
56
32

28
58
60
44
42
X2
40
56
62
52
32

TRASH CAN ASSEMBLY WITH LOCKING LID

RELATED CASES

This is a continuation-in-part of Ser. No. 10/828,067, filed Apr. 19, 2004, now U.S. Pat. No. 7,086,550 whose disclosure is incorporated by this reference as though fully set forth herein.

BACKGROUND OF THE INVENTION

1. Field of the Invention

The present invention relates to household items, and in particular, to a trash can assembly that allows for convenient use.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can.

Unfortunately, to keep the lid open, the user must keep his or her foot on the pedal. If the user needs to move away from the trash can to get additional trash, or to get a new liner, the lid will slam shut. In addition, if the user is attempting to sort the contents inside the trash can, or searching for something that may have been inadvertently tossed into the trash can, it can be uncomfortable and inconvenient for the user to keep his or her feet on the pedal while maneuvering the hands inside the trash can.

Thus, there remains a need for a trash can that allows for convenient use thereof.

SUMMARY OF THE DISCLOSURE

It is an object of the present invention to provide a trash can assembly that allows the user to use the trash can more conveniently.

It is another object of the present invention to provide a trash can assembly where the lid can be temporarily locked in an opened position.

In order to accomplish the objects of the present invention, there is provided a trash can assembly that has a shell, a lid fitted over the top end of the shell, a foot pedal positioned adjacent the bottom end of the shell, a link assembly coupling the foot pedal and the lid, and a locking member associated with the shell. The locking member engages the rod of the link assembly to maintain the lid in an open position without pressing the foot pedal.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
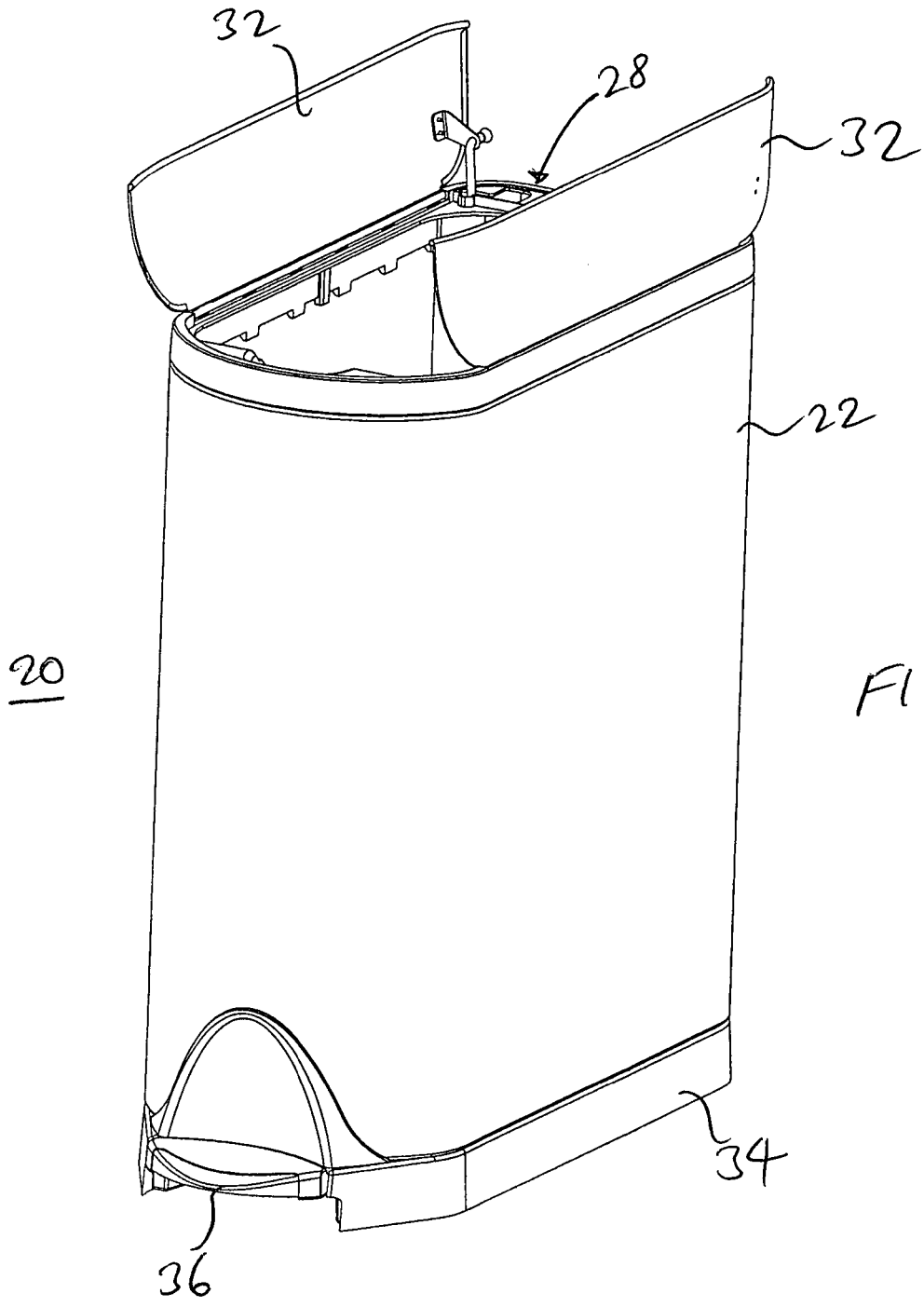
FIG. 1 is a perspective view of a trash can assembly according to one embodiment of the present invention shown with the lid opened.
Figure 2A:
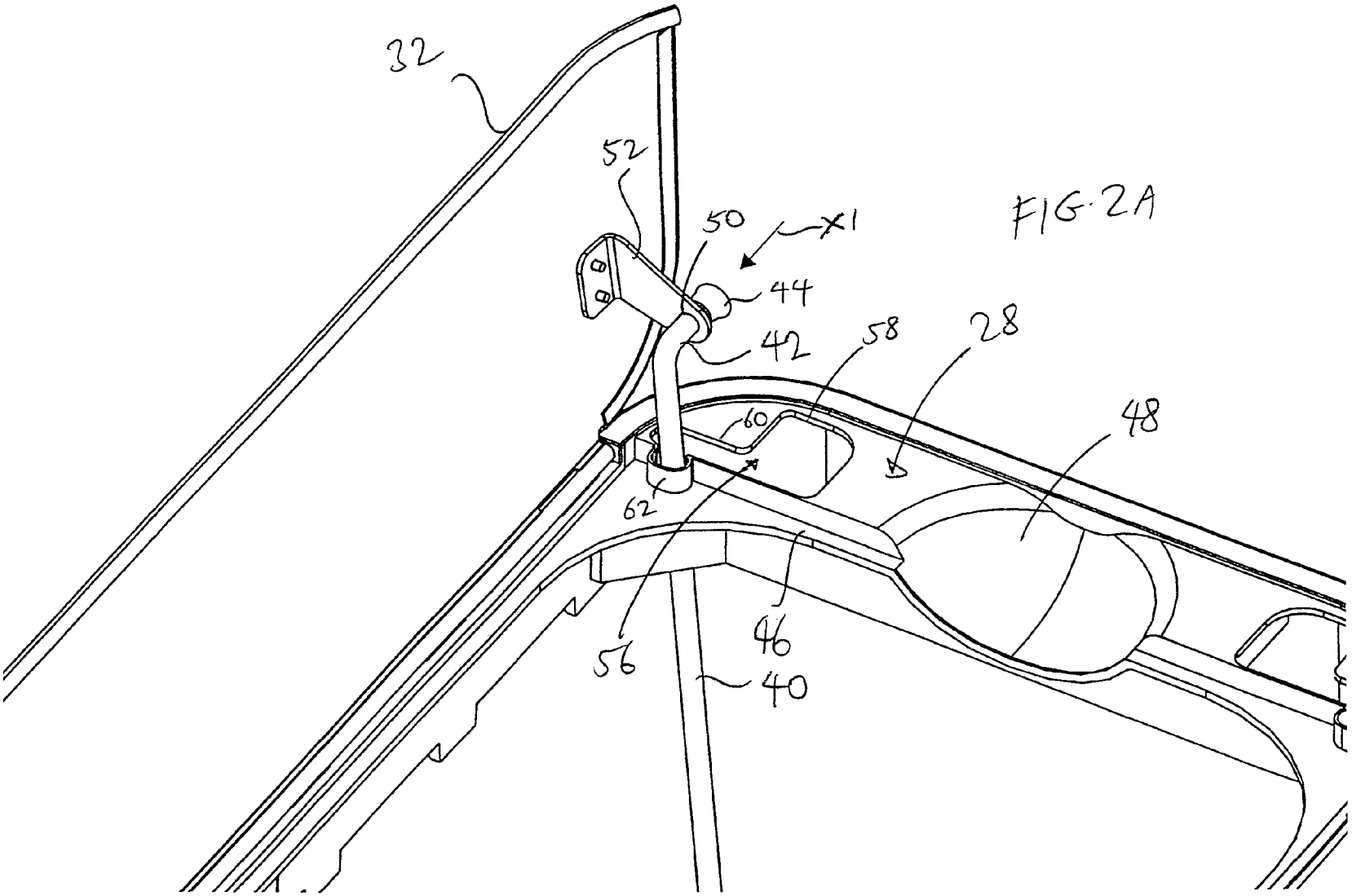
FIGS. 2A-2E are perspective views illustrating the operation of the locking mechanism of the lid for the trash can assembly of FIG. 1.
Figure 2B:
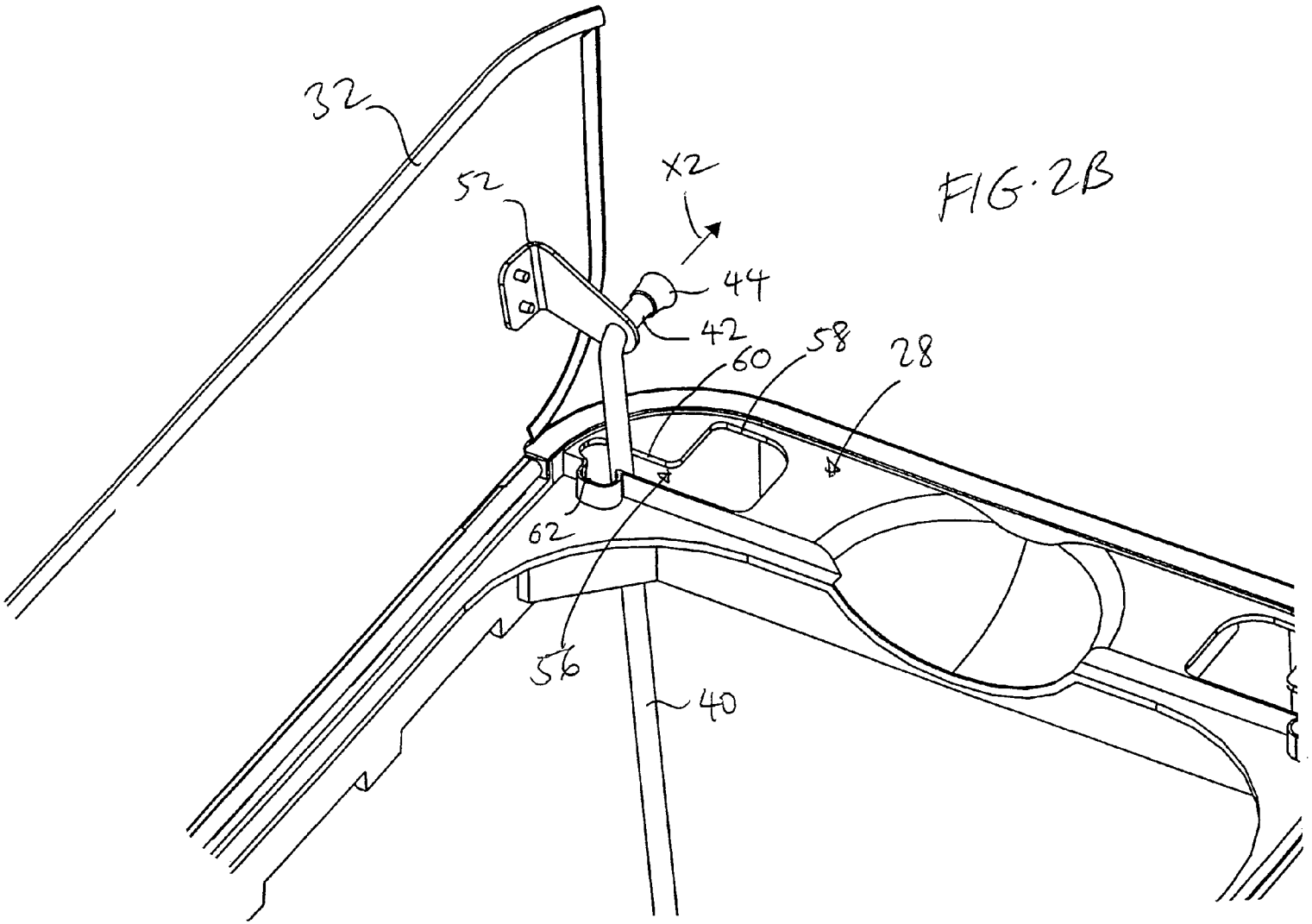
Figure 2C:
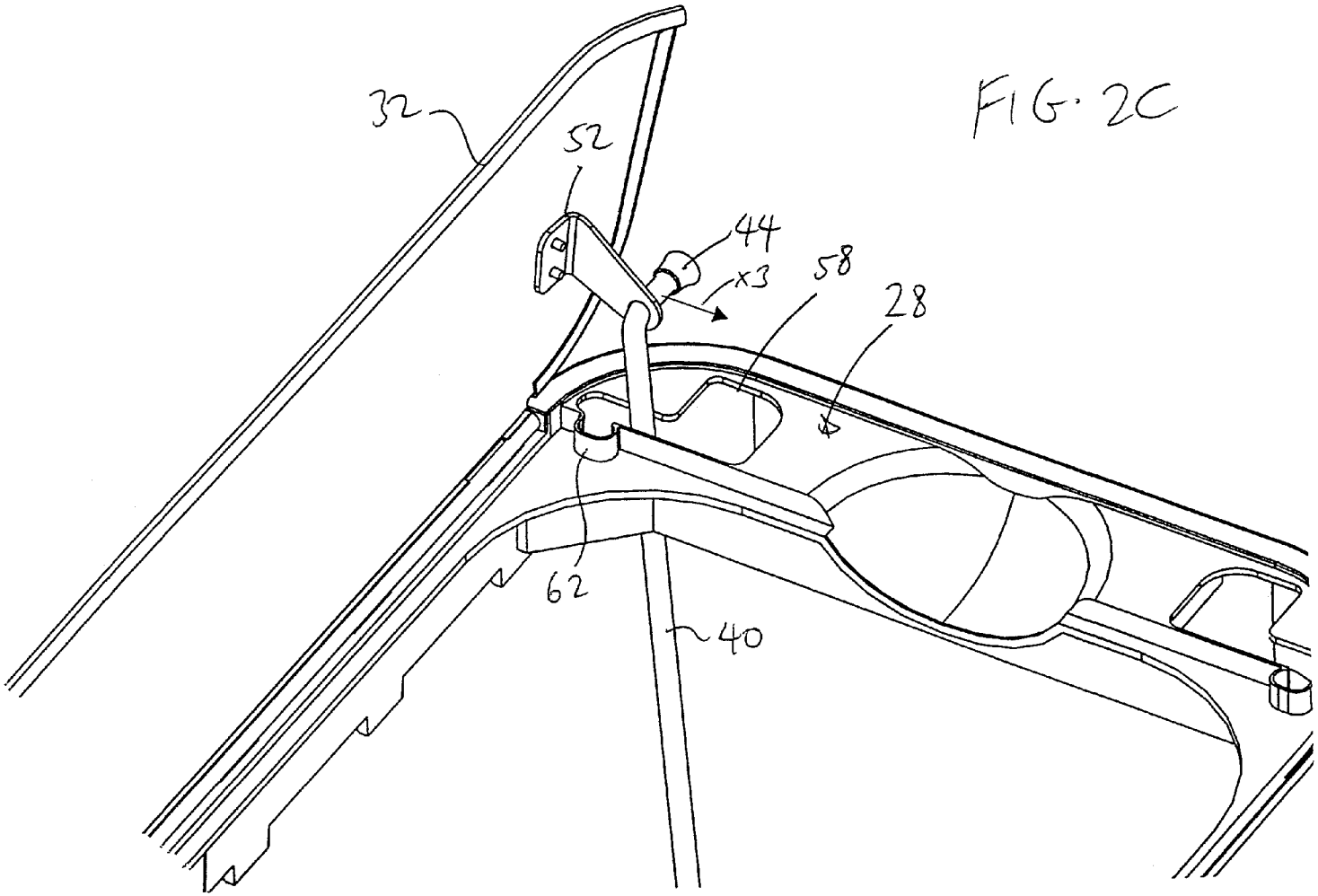
Figure 2D:
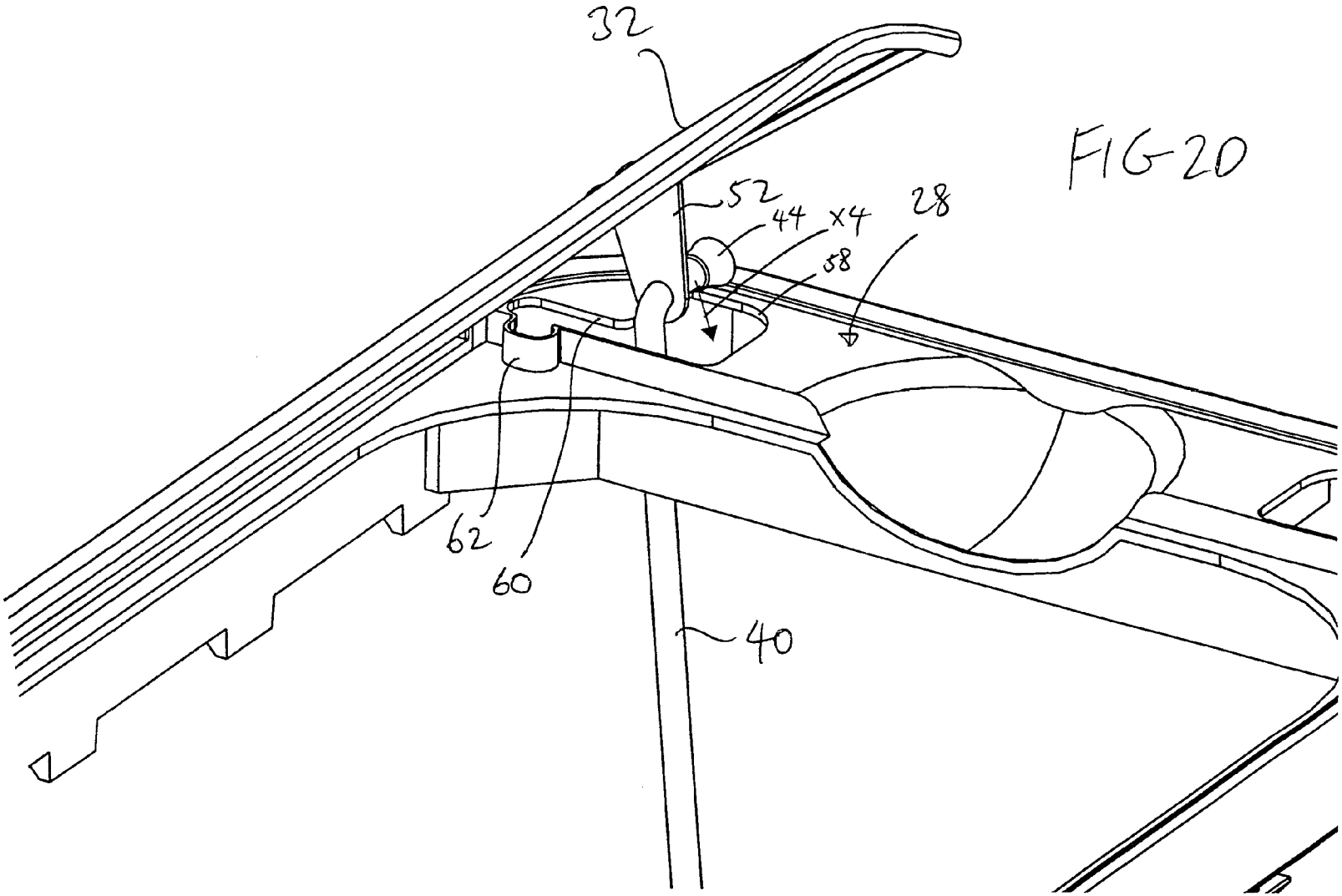
Figure 2E:
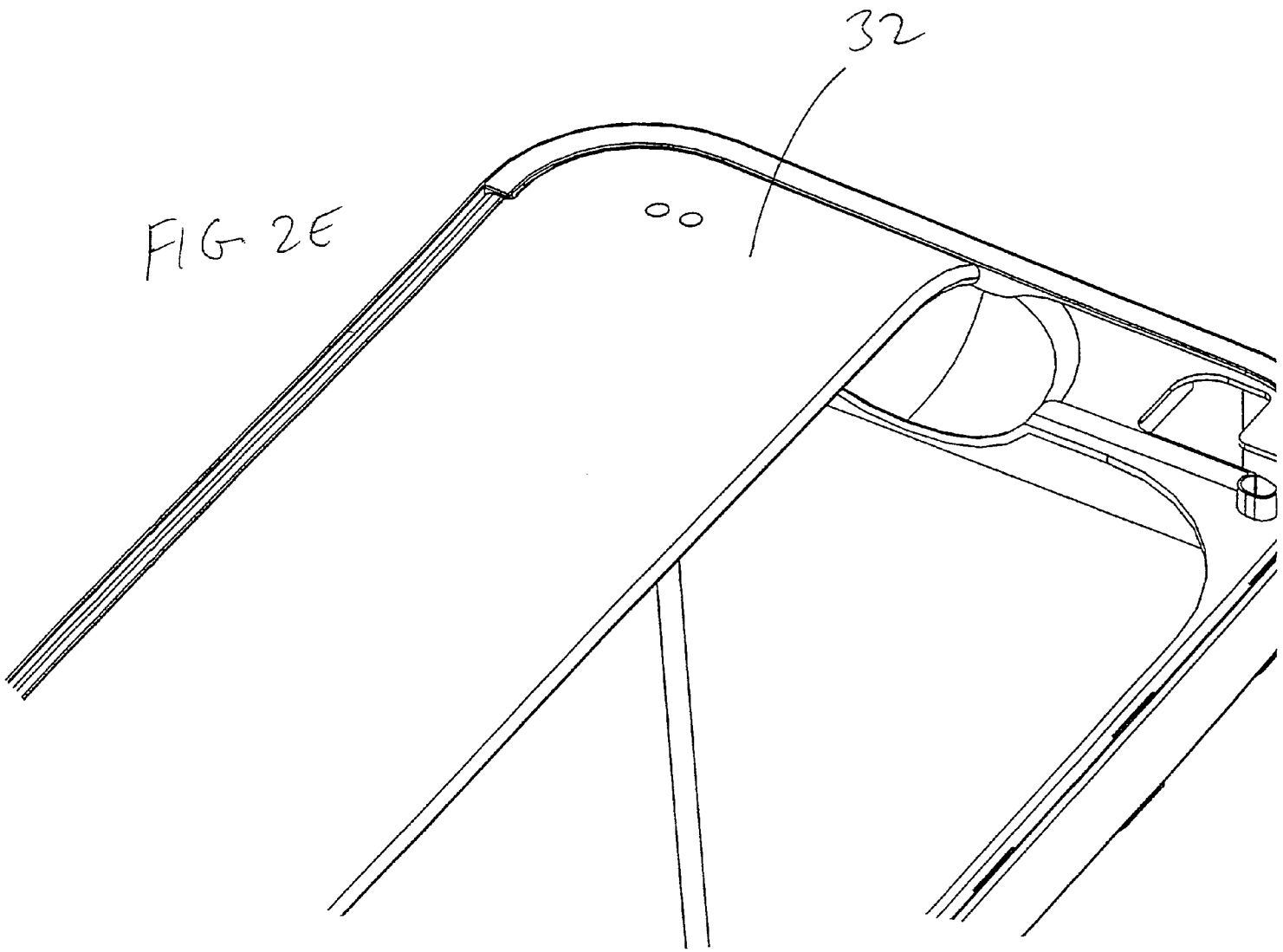

FIGS. 1-2E illustrate one embodiment of a trash can assembly 20 according to the present invention. The assembly 20 has a shell 22 and an internal liner (not shown) that is adapted to be retained inside the shell 22. The shell 22 can be made from either plastic or metal. The liner is essentially a container, and can also be made from either plastic or metal. The shell 22 is an enclosing wall which can have any desired shape, including oval, triangular, rectangular, square or circular (among others). The liner can have the same shape as the shell 22. An upper support frame 28 can be secured to the opened top of the shell 22, and can be provided in a separate material (e.g., plastic if the shell 22 is metal) from the shell 22.

A pair of lids 32 is hingedly connected to the upper support frame 28 using hinged connections that are well-known in the art, and will not be described in greater detail herein. As one non-limiting example, each lid 32 can be hingedly connected to the shell 22 in the manner that is described in U.S. Publication No. US-2004-0004080-A1, published on Jan. 8, 2004 and entitled "Trash Can Assembly", whose entire disclosure is incorporated by this reference as though set forth fully herein. The shell 22 and its lids 32 can be made of a solid and stable material, such as a metal. The shell 22 has a base 34, and a foot pedal 36 is pivotably secured to the base 34.

A link assembly extends from the foot pedal 36 along the base 34 and then upwardly along the rear shell 22 to the upper support frame 28 and each lid 32. The link assembly operates to translate an up-down pivot motion of the pedal 36 to a corresponding up-down pivot motion for each lid 32. The construction and operation of link assemblies are well-known in the art, and will not be described in greater detail herein. As one non-limiting example, the link assembly, foot pedal 36 and the lids 32 can be constructed in accordance with that which is described in U.S. Publication No. US-2004-0004080-A1, published on Jan. 8, 2004 and entitled "Trash Can Assembly".

The link assembly includes a pair of link rods 40, with each rod 40 extending from the base 34 upwardly along one edge of the rear of the shell 22 to the upper support frame 28 so that each rod 40 is aligned with a rear corner of the lid 32 (see FIG. 1). Only one link rod 40 and its accompanying hinge components are shown in FIGS. 1-2E, but both pairs of link rods 40 and their accompanying hinge components are the same. Referring to FIGS. 2A-2D, each link rod 40 has a hooked end 42 that is adapted to be inserted through a hole 50 in an L-shaped bracket 52 that is fixedly secured (e.g., by screws) to the underside of each lid 32 at a corner of the lid 32. The hooked end 42 has a length that allows it to experience back and forth sliding motion within the hole 50 in the bracket 52. However, an enlarged stop member 44 is provided at the end of the hooked end 42 to prevent the hooked end 42 from being disengaged from the hole 50, and for the user to push against.

Thus, pressing and releasing the pedal 36 will cause the upper hooked end 42 of each link rod 40 to move up and down, respectively, thereby opening and closing (via the force of gravity) the lid 32, which is well-known in the art.

The support frame 28 has an L-shaped slot 56 provided at each rear corner of the shell 22. Each slot 56 is sized and configured to allow the bracket 52 to extend therethrough and into the interior of the shell 22. In particular, each slot 56 has a leg section 58 that has a width which is slightly greater than the length of the hooked end 42. Each slot 56 also has an elongate section 60 extending from the leg section 58, with a generally semi-circular lock section 62 extending to a side of the elongate section 60 that is opposite to the side to which the leg section 58 extends.

The upper support frame 28 has an annular recessed wall 46. One or more cut-outs or grooves 48 are spaced-apart about the wall 46. The grooves 48 allow the user to insert his or her fingers through the grooves 48 under the upper lip of the internal liner to lift the internal liner from the interior of the shell 24 when the lids 32 are opened. This provides a convenient way for the user to remove the internal liner from the shell 22, without requiring the user to place his or her hands inside the internal liner to grip the internal liner.

FIGS. 2A-2E illustrate how each lid 32 can be locked in an open position. FIG. 2A illustrates the lid 32 locked in the open position. This locked open position is obtained by the user stepping on the foot pedal 36, which causes the hooked end 42 to push the bracket 52 and the lid 32 upwardly. The user then pushes the stop member 44 inwardly in the direction of the arrow X1 to secure the rod 40 into the lock section 62 of the slot 56. Thus, the lock section 62 functions as a locking member that secures the rod 40 in a raised position to lock the lid 32 in an opened position.

When the user wishes to close the lid 32, the user disengages the rod 40 from the lock section 62. This can be accomplished by pulling the stop member 44, or pushing the top of the rod 40, outwardly in the direction of the arrow X2, as shown in FIG. 2B. The rod 40 will become disengaged from the lock section 62 and will enter the elongate section 60 of the slot 56. At this time, the weight of the lid 32 (coupled with the force of gravity) will push the rod 40 and hooked end 42 downwardly as the lid 32 pivots downwardly, causing the rod 40 and hooked end 42 to move in the elongate section 60 towards the leg section 58 in the direction of the arrow X3, as shown in FIG. 2C. The weight of the lid 32 (coupled with the force of gravity) will eventually push the rod 40 and hooked end 42 downwardly into the leg section 58, where the hooked end 42 will begin a downward motion into the interior of the shell 22 in the direction of the arrow X4, as shown in FIG. 2D. Then, as shown in FIG. 2E, the lid 32 will eventually pivot downwardly until it completely covers the top of the shell 22 in a closed position. In this closed position, the rod 40, the hooked end 42 and the bracket 52 are all retained in the interior of the shell 22.

To open the lid 32 again, the user merely steps on the foot pedal 36, which causes the hooked end 42 to push the bracket 52 and the lid 32 upwardly. The rod 40, the hooked end 42, the bracket 52 and the lid 32 will experience the same motion, in reverse manner, as described above in connection with FIGS. 2D, 2C and 2B. When the rod 40 and the lid 32 reach the position shown in FIG. 2A, the user then pushes the stop member 44 inwardly in the direction of the arrow X1 to secure the rod 40 into the lock section 62 of the slot 56.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having an interior, a top end that defines a periphery, and a bottom end;

a lid fitted over the top end;

a foot pedal positioned adjacent the bottom end of the shell;

a link assembly coupling the foot pedal and the lid, the link assembly including a rod that extends vertically in the interior of the shell; and a support frame extending around the entire periphery of the top end of the shell, the support frame having a slot through which the rod extends, the slot having a lock section in the interior of the shell that engages the rod along the vertical length of the rod to maintain the lid in an open position without pressing the foot pedal.

2. The assembly of claim 1, further including a bracket fixedly secured to the lid, with the rod pivotably coupling the bracket.

3. The assembly of claim 2, wherein the bracket is positioned inside the interior of the shell when the lid is closed.

4. The assembly of claim 2, wherein the rod includes a hooked end that is pivotably coupled to the bracket.

5. The assembly of claim 4, further including a stop member provided on the hooked end.

6. A trash can assembly, comprising:

a shell having an interior, a top edge that defines a periphery, and a bottom end;

a lid fitted over the top end;

a foot pedal positioned adjacent the bottom end of the shell;

a link assembly coupling the foot pedal and the lid, the link assembly including a rod having a vertical length, and a top end that pivotably couples the lid;

a support frame extending around the entire periphery of the top edge of the shell, the support frame having a slot through which the rod extends, the slot having a lock section that engages the rod along the vertical length of the rod at a location offset from the top end of the rod, to maintain the lid in an open position without pressing the foot pedal.

7. A trash can assembly, comprising:

a shell having an interior, a top end and a bottom end;

a lid fitted over the top end;

a foot pedal positioned adjacent the bottom end of the shell;

a link assembly coupling the foot pedal and the lid, the link assembly including a rod that extends vertically in the interior of the shell; and a locking member provided in the interior of the shell through which the rod extends, the locking member having a first section that engages the rod along the vertical length of the rod to maintain the lid in an open position without pressing the foot pedal, and a second section in which the rod is positioned when the lid is closed.

8. The assembly of claim 7, wherein the locking member further includes a third section, with the rod travelling through the third section as the rod moves between the first and second sections.

9. The assembly of claim 1, wherein the slot occupies a plane that is horizontal with respect to the ground.

10. The assembly of claim 1, wherein the support frame is provided in a single piece, with the slot cut from the single piece.

11. The assembly of claim 6, wherein the slot occupies a plane that is horizontal with respect to the ground.

12. The assembly of claim 6, wherein the support frame is provided in a single piece, with the slot cut from the single piece.

13. The assembly of claim 7, wherein the locking member occupies a plane that is horizontal with respect to the ground.

* * * * *